United States Patent [19]

Näpflin

[11] 4,417,749

[45] Nov. 29, 1983

[54] SKI BINDING WITH STEP-IN FRAME

[76] Inventor: Hans Näpflin, Kastanienallee 5, CH 6375 Beckenried, Switzerland

[21] Appl. No.: 297,107

[22] Filed: Aug. 28, 1981

[30] Foreign Application Priority Data

Sep. 3, 1980 [AT] Austria ..... 4435/80

[51] Int. Cl.[3] ..... A63C 9/085

[52] U.S. Cl. ..... 280/614; 280/618; 280/632; 292/58

[58] Field of Search ..... 280/614, 617, 618, 626, 280/631, 632; 292/57, 58, 59, 240, 241, 242

[56] References Cited

U.S. PATENT DOCUMENTS 3,659,866 5/1972 Petersen ..... 280/626

3,953,042 4/1976 Pyzel et al. ..... 280/614 X

FOREIGN PATENT DOCUMENTS 1050579 3/1979 Canada ..... 280/631

1454510 10/1966 France ..... 280/626

300634 10/1954 Switzerland .

*Primary Examiner*—Joseph F. Peters, Jr.

*Assistant Examiner*—Michael Mar

*Attorney, Agent, or Firm*—Thomas W. Speckman

[57] ABSTRACT

A ski binding provided with a step-in frame which may be firmly connected to the surface of the ski for downhill skiing, released and freely pivotable for level movement or provided with two elevated heel positions for uphill climbing.

4 Claims, 9 Drawing Figures

SKI BINDING WITH STEP-IN FRAME

BACKGROUND OF THE INVENTION

1. Field of the Invention

This invention relates to a ski binding provided with a step-in frame. A step-in frame is a simple and lightweight ski binding for a ski boot to be locked into position. The invention relates in particular to the locking means for such step-in frame.

2. Description of the Prior Art

A step-in frame is usually constructed to be pivotable about a horizontal axis in the region of the toes, transversely to the longitudinal axis of the ski, to facilitate level or uphill movement of the skier, while it is also capable of being immovably secured to the ski during downhill movement. This is accomplished by the locking means.

Swiss Patent No. 300634 to Gujer discloses a ski binding having a diagonal cable in combination with a step-in frame which is fastened to the top of the ski. During downhill skiing, a latch displaceable in a bearing block securely holds the step-in frame down on the ski. For gliding or uphill climbing, the latch is released so that the heel of the ski boot together with the step-in frame is raised up from the ski surface. This binding requires ski boots with flexible soles. For modern ski boots having rigid soles it is preferable to have the step-in frame releasably mounted on the ski by way of the sole plate so that it may be released to protect the skier from leg injury when usually adjustable torsional and tensile forces are excessive.

SUMMARY OF THE INVENTION

An object of the present invention is to provide a locking device for step-in ski bindings which has additional functions besides the two traditional primary functions of holding the step-in frame either in a fixedly secured position or in a released position on the ski and of being pivotable in the toe region. Especially in uphill skiing, energy may be saved when the heel of the boot is able to find a temporary initial support before engaging the ski surface.

The object of the present invention is achieved by a locking means in combination with a step-in frame which is pivotally connected to the top surface of a ski or a sole plate and comprises a bearing block and a holding member. The characteristic features of the step-in frame including the locking means according to this invention are a bearing block which is U-shaped in cross section and a holding member or lever which is pivotally mounted about a first pivot axis provided on the leg of the U-shaped bearing block which faces the step-in frame. The locking lever is pivotally mounted with one end on the holding member by means of a second pivot axis. Pivotally mounted to the locking lever, approximately in the middle thereof, is a third lever by means of a third pivot axis having arranged thereon a roller and a spring clip for spreading the third lever and the locking lever apart. In the locked position, either the roller or the third lever is in close engagement with the other leg of the U-shaped bearing block.

This particular mode of locking enables the step-in frame to assume five different operation positions, namely:

1. The step-in frame is firmly connected to the ski.

2. The step-in frame is released and is freely pivotable about pivot means in the toe region.

3. The step-in frame is pivotable and capable of closely engaging the release plate or the surface of the ski during sliding.

4. The step-in frame is pivotable and capable of engaging an intermediate level support.

5. The step-in frame is pivotable and capable of engaging an elevated support means.

BRIEF DESCRIPTION OF THE DRAWINGS

The drawings illustrate two embodiments of the invention which will be described in further detail hereinafter. In the drawings.

DESCRIPTION OF PREFERRED EMBODIMENTS

Figure 5:
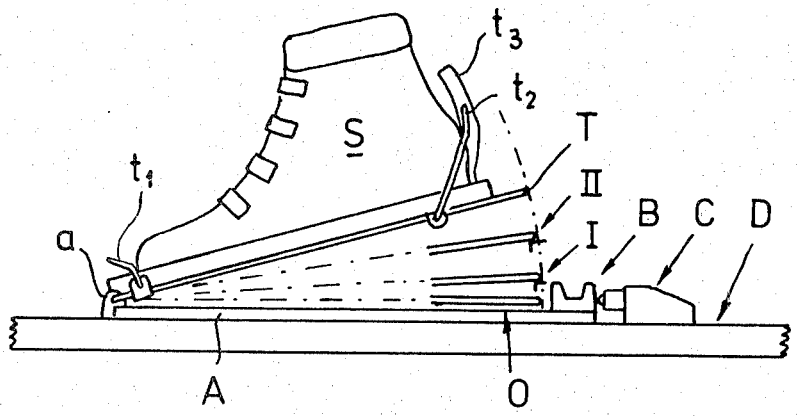
FIG. 5 illustrates a ski boot positioned on a step-in binding including its locking device.

Referring to FIG. 5, S designates a ski boot which is attached to step-in frame T by means of two stirrups $t_1$, $t_2$ and lever $t_3$. The step-in frame is pivotably mounted about pivot "a" on release plate A to which is also secured locking device B for step-in frame T. Release plate A itself is in close contact with the ski top surface D by means of releasable latching means C.

FIG. 5 illustrates some of the pivotal positions of the step-in frame, as they occur during movement of the skier after the step-in frame has been released by the locking means. Position O indicates the hold position in which step-in frame T is maintained on the release plate A by the locking device. This is the position during downhill skiing.

Position I shows the position of the locking device in which it constitutes a stop at an intermediate level. Position II shows the position of the locking device in which it forms a stop at a higher level.

FIGS. 1 to 4 illustrate how these various functions and positions may be realized by means of the three levers of the locking device according to the invention.

Figure 1:
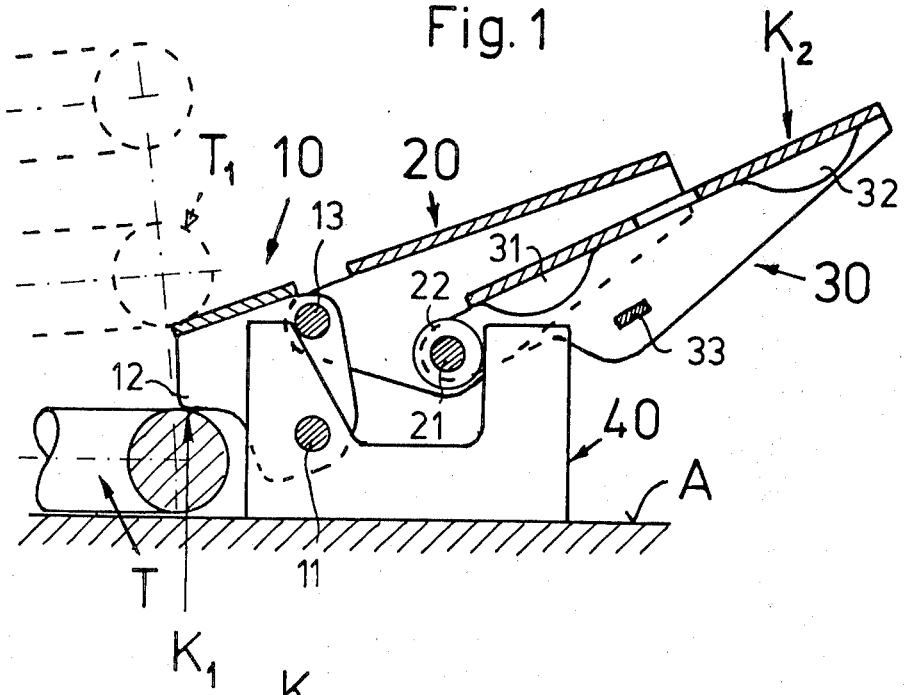
FIGS. 1–3 are side views, partially in section, of the locking device of the invention in three different operational positions.
Figure 4:
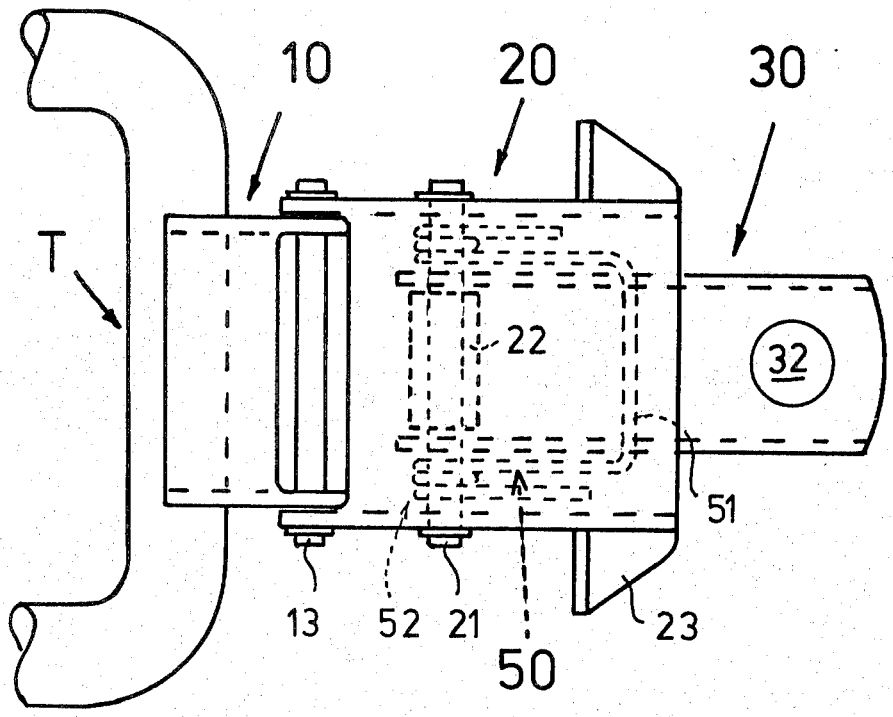
FIG. 4 is a top plan view of the lever system in the position as shown in FIG. 1.

FIGS. 1 and 4 illustrate one position of the train of levers 10, 20, 30 in which lever 10 constitutes the holding member by which the step-in frame T is fixedly retained on the release plate A. After release of the hold position (FIG. 2) and return of the levers 10, 20, 30 to the position according to FIG. 1, the lever 10 forms the intermediate level of a stop for the step-in frame. The hold-down lever 10 is pivotable about the axis 11 provided in the lower region of the U-shaped bearing block 40. In the illustrated position of lever 10, the projection 12 supports the rearward crossbar of the stirrup-shaped step-in frame T which is made of circular sectional material. The lever 10 is made of sheet metal bent into a U shape.

In the position illustrated in FIGS. 1 and 4, a second axis 13 is provided approximately vertically above the axis 11. To this axis 13 is pivotally attached the locking lever 20. The wider lever 20 is likewise made of sheet metal bent to a U-shaped cross section and is provided in approximately its middle section with an axis 21 for rotatably receiving a roller 22. Pivotally mounted on the shaft 21 is a narrower lever 30 made of U-shaped sheet metal. The width of the lever 20 is such that its jaws engage the lever 10 on each side, whereas lever 30 is so narrow that its jaws extend partway around the roller 22, leaving enough space for spring clip 50 (FIGS. 2, 4), the crossbar 51 of which is in abutting relationship with the inside of lever 20. The spring has two spiral components 52 positioned on shaft 21 adjacent the jaws of the third lever 30. The spring clip 50 acts to increase the angle between the two levers 20 and 30.

It will be understood that the "angle between the two levers" in this context is the angle which is formed by the upper portions, that is, the flat connecting piece between the flanges.

The third lever 30 is also made of U-shaped sheet metal, like the other levers. However, unlike the other levers 10 and 20, the lever 30 is provided in its upper portion with two recesses or depressions 31 and 32, and in its middle portion with a holding means in the shape of a cam 33.

In the locking position illustrated in FIG. 1, the shaft 13 is in a slight clamping engagement with the inner side of the forward leg, and the roller 22 engages the inner side of the rearward leg of the bearing block 40. An upwardly directed force $K_1$ emanating from step-in frame T is incapable of dislodging the levers from the position as illustrated, but merely enhances the pressure exerted by the roller 22 on the rearward leg of the bearing block 40.

The locking position is easily released, however, if a force $K_2$ is exerted upon the lever 30, for example, by the tip of a ski pole. The pole tip is inserted into the depression 32, whereby the underside of the depression 31 is urged against the top of the rearward leg of the bearing block 40, thus forming a pivot bearing for the lever 30. In this manner, the three lever train assumes the position illustrated in FIG. 2, so that the holding bar 33 is caused to contact behind the rearward leg of the bearing block 40 and the spring clip 50 increases the angle between the levers 20 and 30.

Figure 2:
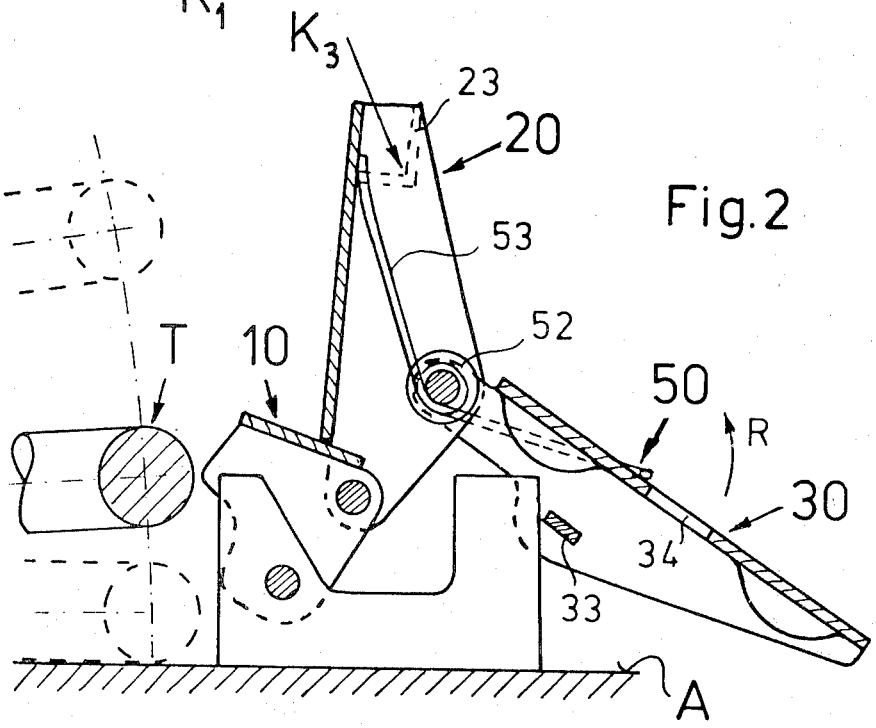

In the position of FIG. 2, step-in frame T is released so that it is free to be pivoted about the axis "a" (FIG. 5) and be moved downward onto the sole plate A.

If it is desired during climbing to make use of an intermediary level stop, the levers must first be returned to the position of FIG. 1, with the crosspiece of the step-in frame remaining free, however. This may be accomplished very easily. The outer side of the locking lever 20 is provided with bars 23. Again, exerting a force upon lever 20 with the tip of a ski pole in the direction indicated by $K_3$ (FIG. 2) causes the lever system to return to the position of FIG. 1.

Figure 3:
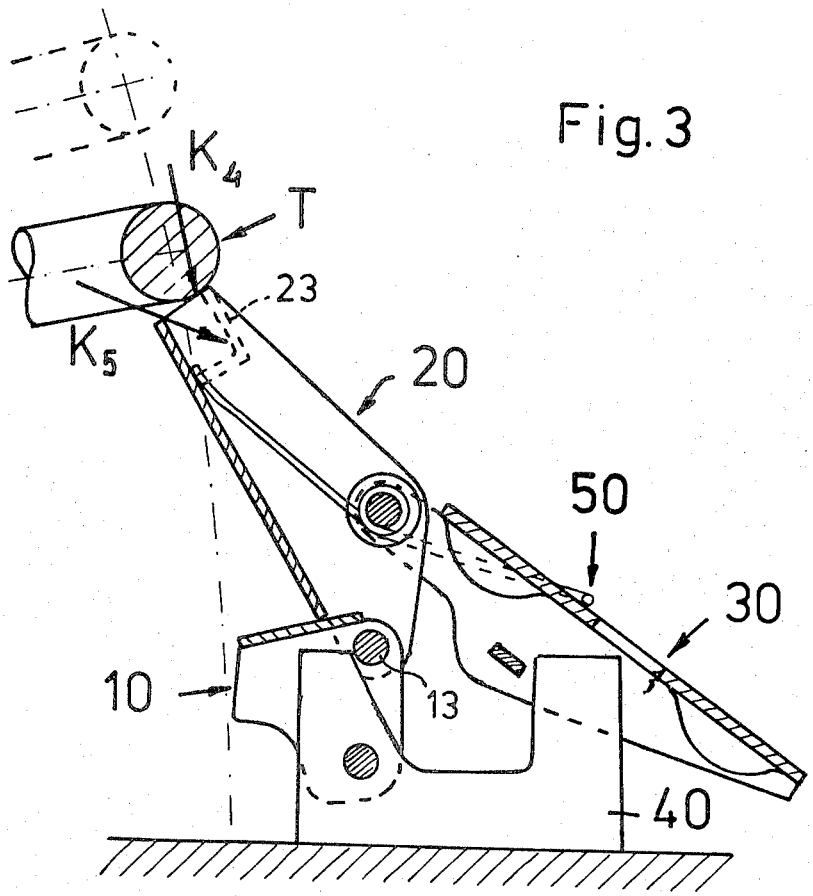

If a steep uphill climb makes a still higher level stop desirable, the lever system is first put in the position as shown in FIG. 3. Again, to be able to do this with the tip of a ski pole, lever 30 is provided with hole 34 between the two depressions 31 and 32. As shown in the position illustrated in FIG. 2, the pole tip is inserted into hole 34 so that the lever 30 is pivoted in the direction of the arrow R and, with the assistance of the spring 50, reaches the position according to FIG. 3. In this position, shaft 13 of lever 10 is in abutment with the inner side of the forward leg of bearing block 40 and lever 20 is supported by lever 10.

Since the force exerted by the step-in frame T on lever 20 can occur only in the direction $K_4$, the force of spring 50 is sufficient to retain the levers in the illustrated position. The force exerted in the direction $K_4$ merely increases the bearing loads of lever 20 on lever 10 and of shaft 13 on bearing block 40.

Again, with the assistance of a pole tip inserted into one of lateral bars 23, the lever system is subjected to a force in the direction $K_5$ and is caused to be returned to the position of FIG. 2 or, by maintaining the force, to the position of FIG. 1. Depending on the position the step-in frame was in when the locking device was actuated, the step-in frame will either be fixedly connected to the sole plate or it will be supported by the intermediate stop means.

FIGS. 6–9 illustrate another embodiment of the locking device described in the foregoing. The component parts which correspond to the parts in FIGS. 1–4 and have the same function are designated with the same reference numerals. The parts which differ from those in FIGS. 1–4 are the lever 300 which is elastic in the longitudinal direction, the oblong bearing block 400, and the spring clip 500. In the illustrated embodiment, the lever 300 is in the form of a ring made of spring steel so that it has longitudinal elasticity in the direction vertical to the pivot axis 21. The ends of the lever 300 simultaneously constitute the pivot axis 21. The elastic construction of the lever 300 has the advantage that the step-in frame is enabled to be released from the locking action when the force $K_{10}$ of FIG. 6 exceeds a certain value. This may be the case in a forward fall of the skier. In this event, the step-in frame causes the lever 10 constituting the hold-down member to pivot clockwise about its axis 11, whereby lever 20 is displaced toward the right and the longitudinal dimension of the lever 300 is shortened. In consequence thereof, roller 22 is caused to roll from the supporting surface 410 onto the rising incline 420. The pivot joints 13, 22, 301, being aligned along a straight line are urged out of their dead center position, the levers arrive at the position shown in FIG. 7 and the release of the step-in frame T from the locking action is completed.

Figure 6:
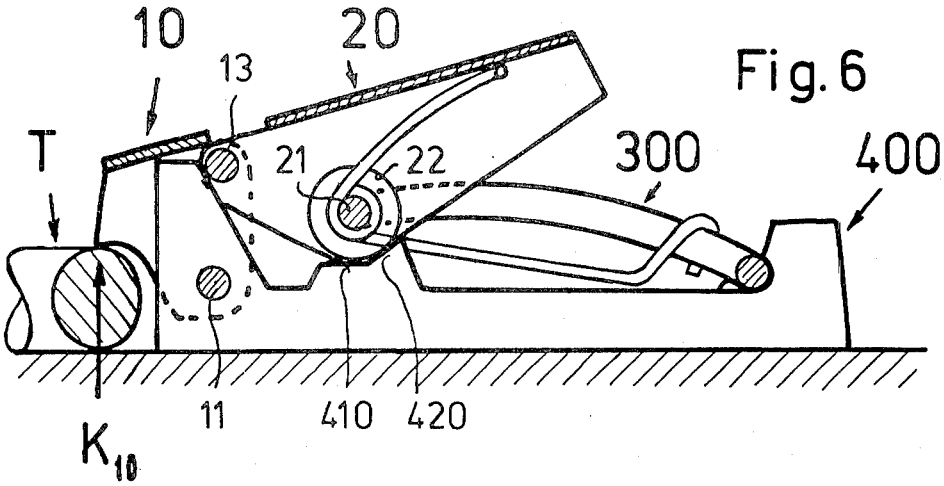
FIGS. 6–8 illustrate a modification of the locking device of FIGS. 1–4 shown in three different operational positions.

The relative position of the three levers 10, 20 and 300 shown in FIG. 6 correspond to the position shown in FIG. 1. The step-in frame may also be released manually from its locked position by slightly raising the lever 20.

Figure 7:
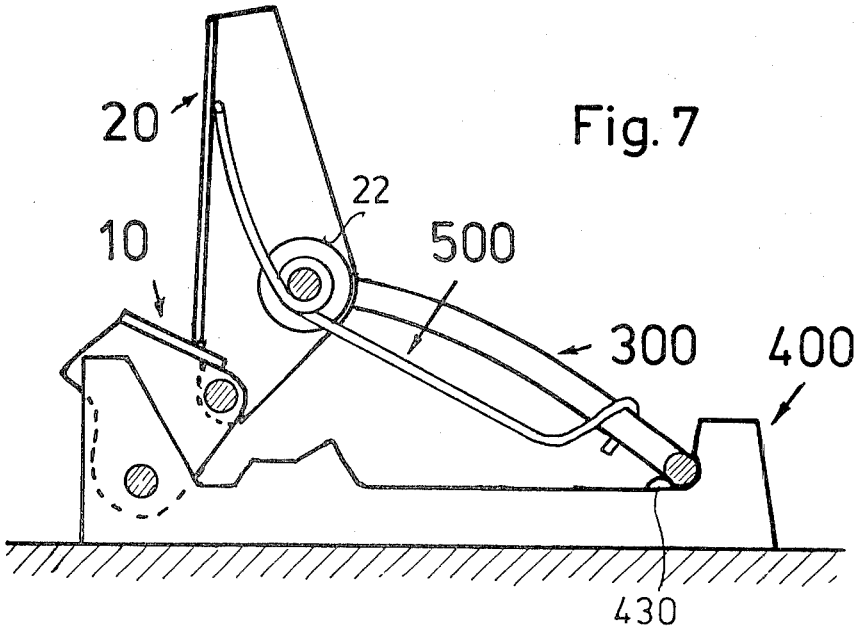
Figure 8:
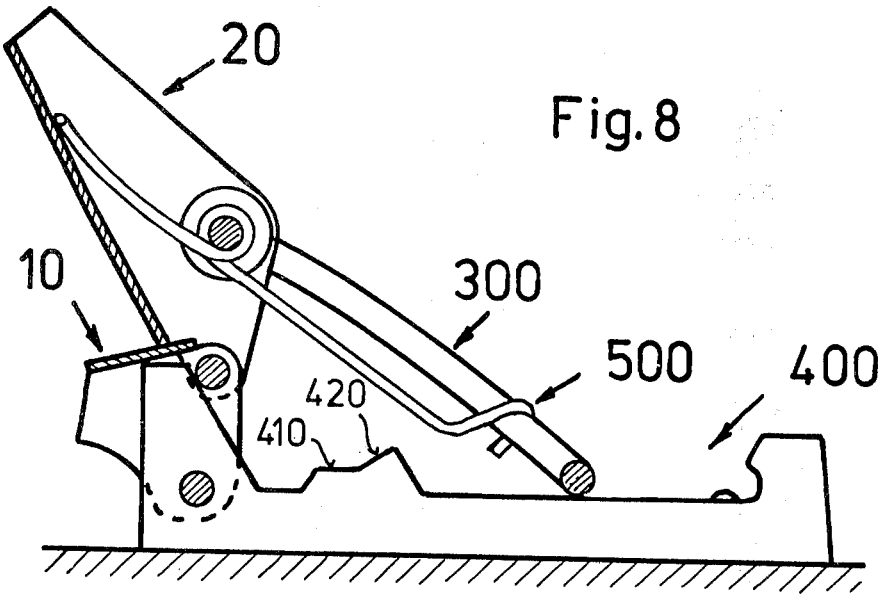
Figure 9:
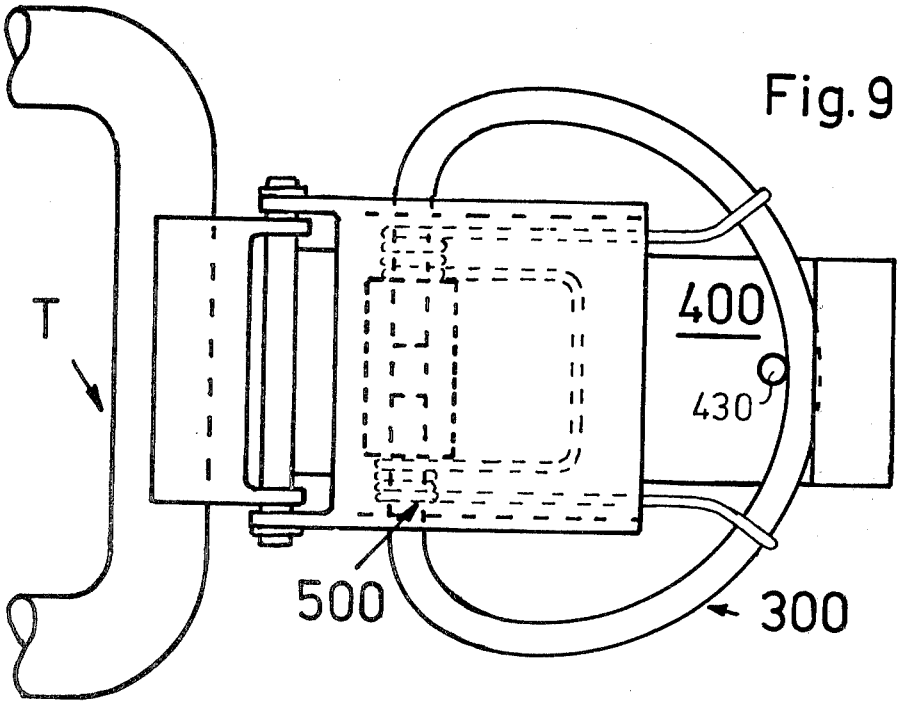
FIG. 9 is a top plan view of the lever system in the position as shown in FIG. 6.

When the step-in frame is in a released position and the levers are returned to the position of FIG. 6, lever 10 then forms an intermediate stop for gliding movement. Cam 430 is provided to retain the levers in the position as illustrated in FIG. 7, wherein spring clip 500 urges lever 20 onto lever 10. Lever 300 is in a relaxed condition. However, a slight lifting of the lever 300 will cause levers 10, 20, 300 to assume the position illustrated in FIG. 8 which corresponds to the relative position of the levers according to FIG. 3. This means that the two levers 10 and 20 together form a higher level stop for the step-in frame, as it may be desired for a steep uphill climb.

The locking device for a step-in frame is so constructed that it will not only selectively retain the step-in frame (T) firmly on the ski or release it, but in addition is adjustable to form stop means at two optional levels of elevation. The locking device includes a train of three levers pivotally attached to a bearing block. In a first relative position (O) of the three lever train, the step-in frame (T) is firmly connected to the top surface of the ski for downhill skiing, or the lever train forms a first supporting position (I) for the step-in frame during uphill climbing. In a second relative position of the levers, the step-in frame is released. In a third relative position, the levers form a higher level supporting position (II) for a steep uphill climb.

Thus, five different operational positions are available:

1. Step-in frame is firmly connected to the surface of the ski for downhill skiing.
2. Step-in frame is released and freely pivotable about a pivot axis "a" for level gliding.
3. Step-in frame is released, as before, with stop at release plate (A).
4. Step-in frame is released, as before with intermediate stop (I).
5. Step-in frame is released, as before, with stop at a higher level (II). (FIG. 5)

While in the foregoing specification this invention has been described in relation to certain preferred embodiments thereof, and many details have been set forth for purpose of illustration, it will be apparent to those skilled in that art that the invention is susceptible to additional embodiments and that certain of the details described herein can be varied considerably without departing from the basic principles of the invention.

I claim:

1. A ski binding comprising a step-in frame which is pivotally connected to the surface of the ski or to a sole plate at its forward end by means of pivotal connection, said step-in frame being adapted to be locked in position with respect to the top surface of the ski or the sole plate at its rearward end by means of a locking device, said locking device comprising a bearing block and a hold-down lever controlled by a locking lever, characterized in that said bearing block (40) has an open U-shaped cross section and profile forming a forward and rearward upstanding leg, said hold-down lever (10) is pivotally mounted in its lower portion about a first pivot axis (11) provided on said forward leg of said bearing block (40) adjacent said step-in frame portion of said binding, said locking lever (20) being pivotally attached at its forward end to said hold-down lever (10) by means of a second pivot axis (13), said locking lever (20) having pivotally attached to is its middle section a third lever (30) by means of a third pivot axis (21) at the forward end of said third lever on which said third pivot axis is mounted a roller (22) and a spring clip (50), said spring clip urging said third lever (30) and said locking lever (20) radially apart about said third pivot axis towards a releasing position, and in a locking position, said roller (22) is pressed into engagement with the inner side of said rearward leg of said U-shaped bearing block.

2. A ski binding according to claim 1, characterized in that in the locking position the distance between said three pivot axes (11, 13, 21) is selected so that the connecting lines between said three pivot axes form an acute-angled triangle.

3. A ski binding according to claim 1, characterized in that in the open position of said three levers (10, 20, 30), the connecting lines between said three pivot axes (11, 13, 21) extends approximately along a straight line, and that a cam (33) provided on said third lever is in engagement with the outer side of said rear leg of said U-shaped bearing block (40) and said locking lever (20) is supported by said hold-down lever (10).

4. A ski binding according to claim 1, characterized in that in a further position of said three levers (10, 20, 30) the connecting lines between said three pivot axes (11, 13, 21) extends approximately along a straight line, and that said spring clip (50) causes the angle between said locking lever (20) and said third lever (30) to be approximately 180°, and the rear of said step-in frame is supported in a raised position by the free end of said locking lever.

* * * * *